US005414899A

United States Patent [19]

Raetz

[11] Patent Number: 5,414,899

[45] Date of Patent: May 16, 1995

[54] PIVOT STRUCTURE FROM A LOCK HANDLE

[75] Inventor: Thomas P. Raetz, Owatonna, Minn.

[73] Assignee: Truth Hardware Corporation, Owatonna, Minn.

[21] Appl. No.: 95,155

[22] Filed: Jul. 20, 1993

[51] Int. Cl.[6] ..... E05D 5/12

[52] U.S. Cl. ..... 16/380; 29/523; 403/153

[58] Field of Search ..... 16/380, 228, 237, 337, 16/342, DIG. 33, 338, 383, 339, DIG. 6; 292/101, DIG. 20, DIG. 30, DIG. 33; 29/434, 436, 437, 523, 11; 403/152, 153, 277, 278, 279

[56] References Cited

U.S. PATENT DOCUMENTS 1,798,890 3/1931 Mayo et al. .
2,422,327 6/1947 Winslow .
2,613,525 10/1952 Holmsten .
2,774,098 12/1956 Tieri .
2,828,668 4/1958 De Angelis .
2,939,168 6/1960 Ferron .
3,042,961 7/1962 Tieri .
3,270,536 9/1966 Sprung .
4,018,104 4/1977 Bland et al. .
4,256,388 3/1981 Beyer .
4,428,094 1/1984 Emain .
4,586,750 5/1986 Vogel .
4,630,332 12/1986 Bisbing .
4,630,333 12/1986 Vickers .
4,638,544 1/1987 McNeil .
4,639,147 1/1987 Schwarz .
4,821,374 4/1989 Gavagan .
4,844,606 7/1989 Smith .
5,103,533 4/1992 Pettit et al. .

*Primary Examiner*—P. Austin Bradley
*Assistant Examiner*—Chuck Y. Mah
*Attorney, Agent, or Firm*—Wood, Phillips, Van Santen, Clark & Mortimer

[57] ABSTRACT

A pivotal connection between a handle and a housing including a pivot defining member biased outwardly into frictional contact with concentric openings in a handle and housing. The member includes a sleeve portion with an outer diameter $O_S$ substantially equal to or less than the diameter of the housing and handle openings, the sleeve portion further including a tubular opening having a selected inner diameter $I_S$. The member further includes a longitudinally extending pin portion circumscribed by a reference cylinder having a diameter $D_C$ and an end section inscribing a reference cylinder having a diameter $D_I$, where $D_I \leqq I_S < D_C < O_S$, Circumferentially disposed connecting segments project radially outwardly from the pin portion end section and are breakably secured to the sleeve portion. The sleeve portion and pin portion are initially longitudinally secured end to end at circumferentially spaced locations, with the pivot defining member being assembled with the handle and housing by locating its sleeve portion within the housing and handle openings and then breaking the connecting segments by forcing the pin portion into the sleeve portion tubular opening.

27 Claims, 1 Drawing Sheet

PIVOT STRUCTURE FROM A LOCK HANDLE

BACKGROUND OF THE INVENTION

1. Technical Field

The present invention is directed toward pivot structures, and more particularly toward a pivot structure for connecting a window lock handle to its housing.

2. Background Art

Window locks are, of course, well known. One common window lock type uses a handle pivotally mounted to a housing which is itself mounted to the window frame, and a keeper is mounted to the movable window sash. The handle may be manually pivoted to move a grasping member into and out of engagement with the keeper to lock or release the window sash as desired.

Commonly, such lock handles have been pivotally secured to the housing by a rivet. Further, a spring washer has commonly been disposed between the handle and the housing, such washer frictionally engaging the handle to create a torque necessary to operate (i.e., pivot) the handle. However, such lock structures can have a tendency to lose the operating torque initially manufactured into the lock, such that the handle eventually may be able to rotate freely relative to the housing. In installations where there are two such locks and the sash is moved by an operator crank, this can make it virtually impossible for one person to open or close the window (needless to say, it is very difficult for a person having only two hands to hold two lock handles in the necessary position while also turning the operator crank).

Still other pivot structures are, of course, known and used in other types of environments as shown, for example, in U.S. Pat. Nos. 4,821,374, 4,639,147, 4,638,544, 4,630,333, 4,630,332, 4,586,750, and 4,018,104. However, these structures do not solve the above mentioned problem of failure to retain initial operating torque, are difficult to assemble, are undesirably expensive to manufacture, and/or are not readily adaptable for use in the limited space allowed for such window lock pivots.

U.S. Pat. No. 5,103,533 discloses one solution which has been used to avoid the above mentioned problems, using a sleeve with a central tubular opening disposed within concentric housing and handle openings. The sleeve has an outer diameter substantially equal to the diameter of the housing and handle openings, and a cylindrical pin having an outer diameter greater than the inner diameter of the sleeve tubular opening is wedged into the sleeve tubular opening so as to bias the sleeve outwardly into beveled portions of the handle opening, whereby the handle is frictionally maintained in position relative to the housing until moved by an operator. The present invention is directed toward improving upon the invention disclosed in U.S. Pat. No. 5,103,533.

SUMMARY OF THE INVENTION

In one aspect of the present invention, a pivotal connection between a handle and a housing is provided, including a pivot defining member biased outwardly into frictional contact with concentric openings in the handle and housing. The member includes a sleeve portion with an outer diameter $O_S$ substantially equal to or less than the diameter of the housing and handle openings, the sleeve portion further including a tubular opening having a selected inner diameter $I_S$. The member further includes a longitudinally extending pin portion circumscribed by a reference cylinder having a diameter $D_C$ and an end section inscribing a reference cylinder having a diameter $D_I$, where $D_I \leqq I_S < D_C < O_S$, Circumferentially disposed connecting segments project radially outwardly from the pin portion end section and are breakably secured to the sleeve portion. The sleeve portion and pin portion are initially longitudinally secured end to end at circumferentially spaced locations, with the pivot defining member being assembled with the handle and housing by locating its sleeve portion within the housing and handle openings and then breaking the connecting segments by forcing the pin portion into the sleeve portion tubular opening.

In another aspect of the present invention, the pin portion inscribes the reference cylinder having the diameter $D_I$, wherein $D_I < I_S < D_C < O_S$, and the sleeve portion and pin portion are initially longitudinally secured end to end at circumferentially spaced spots.

In still another aspect of the present invention, the sleeve portion and pin portion are unitarily molded from plastic.

In yet another aspect of the present invention, the pin portion has an outer surface which in transverse cross section substantially defines an equilateral convex polygon having at least three sides.

Yet another aspect of the present invention is a method for pivotally connecting a handle to a housing is provided, including the steps of concentrically aligning handle and housing openings, locating the sleeve portion of the above described pivot defining member within the aligned openings, and forcing the pin portion toward the sleeve portion opening whereby the connections between the sleeve portion and pin portion are first broken and the pin portion is then slid into the sleeve portion tubular opening to bias the sleeve portion outwardly into frictional engagement with the handle and housing.

It is an object of the invention to provide a pivot structure which will retain its operating torque over an extended period of time. It is thus a further object of the invention to provide a window lock in which the handle does not pivot freely even after extensive use, thereby ensuring that a single person may reliably control multiple locks and a window operator at the same time during opening and closing operations.

It is another object of the invention to provide a pivot structure which may be easily and inexpensively manufactured.

It is still another object of the invention to provide a reliable and compact pivot structure which may be used in applications where only minimal space is provided for such pivots.

DESCRIPTION OF THE PREFERRED EMBODIMENT

Figure 1:
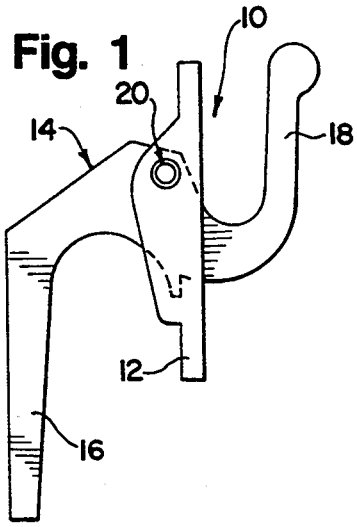
FIG. 1 is a side view of a handle and housing construction having the pivotal connection of the present invention.

A window lock structure 10 embodying the pivot construction of the present invention is shown in FIG. 1. The lock structure 10 includes a base housing 12 with a handle 14 extending through a slot in the housing 12. Typically, the housing 12 is suitably secured (for example, by screws) to the face of a window frame (not shown). The handle 14 includes a handle portion 16 which projects into the dwelling and a grasping portion 18 projecting toward the window sash (also not shown) for grasping a keeper on the sash for locking.

The handle 14 is pivotally secured to the housing 12 by the pivot construction 20 described below.

Figure 2:
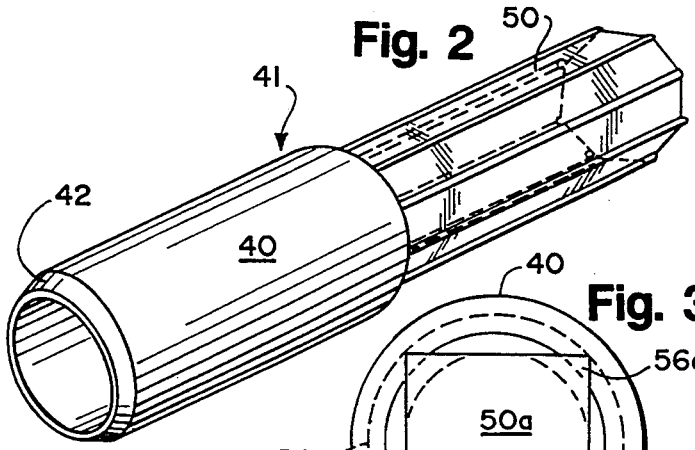
FIG. 2 is a perspective view of the unitary member used in creating the pivotal connection of the present invention.
Figure 4:
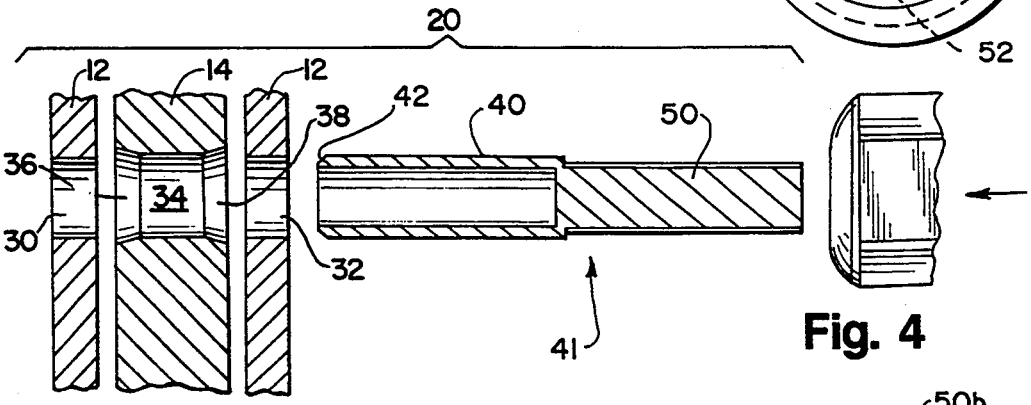
FIG. 4 is a cross-sectional and exploded view illustrating the method of making the pivotal connection of the present invention.

Specifically, in the preferred construction shown in FIGS. 2 and 4, the housing 12 includes a pair of coaxial cylindrical openings 30, 32. The handle 14 also has a cylindrical opening 34 having a diameter substantially equal to the diameter of the housing openings 30, 32, with both ends 36, 38 of the handle opening 34 being tapered or beveled outwardly.

The pivot construction is formed by first inserting a tubular sleeve portion 40 of a unitary member 41 through the housing and handle openings 30, 32, 34 (see FIGS. 2 and 4). Preferably, the sleeve portion 40 should have an outer diameter substantially equal to or slightly less than the diameter of the openings 30, 32, 34 so that it may be easily placed in the openings by manual assembly. The sleeve portion 40 could, however, have a slightly greater diameter than the openings 30, 32, 34 so that a slight frictional force would hold the sleeve portion 40 in place when first located in the openings 30, 32, 34 during assembly although, in that case, the diameter should preferably not be so great as to make it difficult to manually insert the sleeve portion 40 into the openings 30, 32, 34.

Further, the sleeve portion 40 preferably has an end 42 which is tapered down to a diameter well less than the diameter of the openings 30, 32, 34 to ease assembly when initially inserting the sleeve portion 40 into the openings.

The sleeve portion 40 further includes an axial opening 44 through its center so that, when the sleeve portion 40 is in place in the openings 30, 32, 34, a pin portion 50 of the unitary member 41 can be readily forced into the sleeve opening 14. More specifically, in the preferred embodiment as illustrated in FIG. 2, the pin portion 50 is, in cross-section, an equilateral polygon such as the octagon shown.

Figure 3:
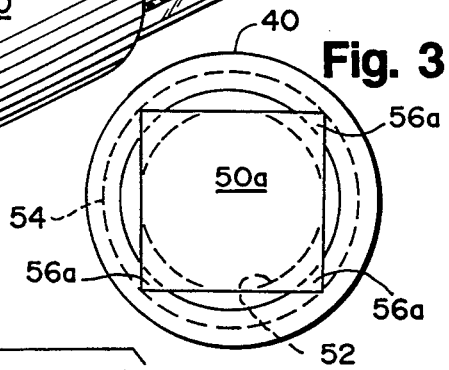
FIG. 3 is an end view of an alternative unitary member.

For illustrative purposes, a pin portion **50*a* having a square cross-section is shown in FIG. 3 to most clearly show the desired relationship of the sleeve portion 40 and pin portion 50. The pin portion 50*a* is sized such that it would inscribe a first reference cylinder 52 which is smaller than the sleeve opening 44 and would be circumscribed by a second reference cylinder 54 which is larger than the sleeve opening 44 and smaller than the outer diameter of the sleeve portion 40. As a result of this configuration, the sleeve portion 40 and pin portion 50*a* may be unitarily formed together (as by plastic molding) so as to be connected end to end at circumferentially spaced spots corresponding to the "corners" 56*a*** of the polygon.

As will be recognized by those who obtain an understanding of the present invention, it is preferred that the pin portion 50 be larger than the sleeve portion opening 44 by an amount which is greater than the difference in size between the sleeve portion 40 and the housing and handle openings 30, 32, 34. Thus, in the preferred embodiment, in addition to the above described relationship, the pin portion 50 has a circumference which is greater than the circumference of the axial opening 44 of the sleeve portion 40 for reasons which will hereafter become apparent. Alternatively, the preferred relationship between the sleeve portion 40 and the pin portion 50 can be defined as follows:

$$A_P > IA_S,$$

WHERE:

$A_P$ = the area of the pin portion in transverse cross section, and $IA_S$ = the area of the sleeve portion axial opening in transverse cross-section.

Perhaps most simply put, the pin portion 50 must be sufficiently large to ensure that it will swell the sleeve portion 40 radially outwardly into frictional engagement with both the housing and handle openings 30, 32, 34, and bulge into the beveled ends 36, 38.

In order to provide the advantages of the present invention, it is further necessary that the pin portion 50 and sleeve portion 40 be so configured that they be connected end to end prior to assembly, where that connection may be broken by forcing the pin portion 50 into the sleeve portion 40. The preferred embodiment providing such a configuration is shown in the figures and has been described above. In that preferred configuration, the sleeve opening 44 is tubular, and the pin portion 50 in transverse cross section (i.e., in a plane perpendicular to the longitudinal axis of the pin portion 50) is substantially an equilateral convex polygon which is circumscribed by one reference cylinder (such as reference cylinder 54) and inscribes a second smaller reference cylinder (such as reference cylinder 52), with the sleeve opening diameter being between the diameters of the inscribed and circumscribing reference cylinders. That is, in this configuration:

$$D_I \leqq I_S < D_C < O_S \leqq H,$$

and $$D_C - I_S > H - O_S,$$

WHERE:

$D_C$ = the diameter of the reference cylinder circumscribing the pin portion;

$D_I$ = the diameter of the reference cylinder inscribed by the pin portion;

$I_S$ = the inner diameter of the sleeve portion tubular opening;

$H$ = the inner diameter of the handle and housing openings; and $O_S$ = the outer diameter of the sleeve portion.

However, it should be understood that at least some of the advantages of the present invention could also be obtained from a wide variety of different shapes. For example, it should by now also be recognized that the above relationship could also be accomplished with a pin portion having an irregular polygon in transverse cross section.

Further, it should also be understood that less preferred embodiments could be made within the scope of the present invention which do not have all of the above described configurations.

For example, the pin portion could be star shaped in transverse cross section (i.e., not convex) so long as the "legs" of the star are sufficiently incompressible so as to adequately swell the sleeve portion where engaged to create the desired frictional bind with the housing and handle.

Figure 5:
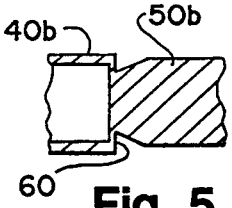
FIG. 5 is a partial cross-sectional view of another alternative of a unitary member.

As another example, as shown in FIG. 5, the pin portion 50*b* could be tapered at one end to an outer diameter no greater than the inner diameter of the sleeve portion 40*b*, with a disk portion 60 having a radially outer portion connected to the end of the sleeve portion 40*b* and a radially inner portion connection on the tapered end of the pin portion 50*b*. With this embodiment, the disk portion 60 would break between its inner and outer portions when the pin portion 50*b* is forced into the sleeve portion 40*b* during assembly. Alternatively, the tapered end of the pin portion 50*b* could be connected to the end and/or inner surface of the sleeve portion 40*b* through discrete radially projecting spoke-like portions.

It should be understood that the preferred form of the various possible embodiments of the present invention is to unitarily form the sleeve portion 40 and pin portion 50 (and disk portion 60 of the embodiment just discussed), as by molding them together as a single part (as such, the discussed portions would most accurately be seen as different sections of a single body). It has been found that acetal is a suitable material for the unitary member, as it can not only be easily molded as desired, but also has the desired physical characteristics for the pivot construction 20, including the ability to creep as described further below.

It should, however, be recognized that some of the advantages of the present invention could also be obtained by separately forming the sleeve portion 40 and pin portion 50 (of the same or different materials) and then securing those portions together to create the unitary member used in manufacture of the pivot construction 20.

More specifically, the lock structure 10 using the pivot construction 20 of the present invention can be simply and inexpensively manufactured as follows. First, the unitary member 41 is positioned within the housing and handle openings 30, 32, 34. The pin portion 50 is then forced into the sleeve portion 40 by simple manual techniques, as by supporting the opposite side of the housing 12 on an anvil type surface and hammering the pin portion 50 into the sleeve portion 40 from the other side (see FIG. 4). Because of the above described configuration, hammering the pin portion 50 will break the connections at the corners 56 of the pin portion 50 and, due to the smaller size of the remainder of the pin portion 50 relative to the sleeve portion axial opening 44, the pin portion 50 will readily be forced into the axial opening 44.

Figure 6:
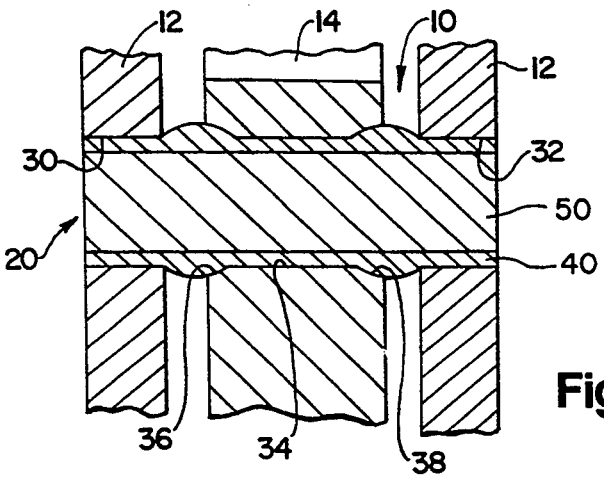
FIG. 6 is a cross-sectional view of the pivotal connection.

As best shown in FIG. 6, the completed pivot construction 20 will result in a press fit between the both ends of the sleeve portion 40 and the housing 12. Further, the plastic sleeve portion 40 is similarly press fit within the handle opening 34 and, in fact, swells to creep into the beveled ends 36, 38 of the handle opening 34. (It should also be understood that while FIG. 3 does generally illustrate the important outer profile of the sleeve portion 40, the exact profile of the engagement between the sleeve portion 40 and the pin portion 50 is complicated and, in any event, dependent on the materials of each part, and therefore may not actually be a uniform cylinder as shown in FIG. 3.)

It has been found that a pin portion 50 having an outer diameter at least 5% greater than the diameter of the sleeve opening 44 is preferred to obtain the above described configuration. More specifically, one such configuration which has been found to be suitable for housing and handle openings 30, 32, 34 having a diameter in the 0.245" to 0.25" range, is a sleeve portion 40 having an outer diameter of approximately 0.24" and an inner diameter of approximately 0.194" works suitably with a generally octagonal pin portion 50 which would inscribe a reference cylinder having an diameter of approximately 0.194" and would be circumscribed by a reference cylinder having a diameter of approximately 0.214".

As will be recognized by those having an understanding of the present invention, the above described unique sleeve and pin construction is not only simple; it is also sturdy. For example, since the sleeve portion 40 is not under any outward pressure when it is inserted into the housing 12 and handle 14 (which are typically both metal), the sleeve portion 40 does not rub against the walls of the openings 30, 32, 34. The pressure is only later added when the pin portion 50 is inserted. Therefore, there is no danger of shaving off the outer surface of the sleeve portion 40 on burrs in the handle 14 and/or housing 12 during assembly (as there would be if, for example, a single oversized pin were forced into the housing and handle openings).

The above described pivot construction will provide a reliable, wobble free pivot axis for the handle 14.

Further, use of the above described pivot constructions can significantly reduce the time, complexity, and expense of manufacture, as well as reducing manufacturing errors and reducing losses from damaging parts through faulty assembly. That is, use of the unitary member 41 reduces the number of different parts required to inventory for manufacture, and also significantly reduces the number of parts which an assembler must handle and align. Still further, the unitary member 41 of the present invention ensures that the sleeve portion and pin portion are automatically aligned as required during the manufacturing process, so that the assembler will be able to properly form the pivot construction 20 with minimal errors.

Still further, the tendency of some prior art window locks to pivot freely after repeated use (due to wear of the sleeve portion) is avoided, thereby ensuring that a single person may reliably control multiple locks and a window operator at the same time during opening and closing operations of a window.

Also, this construction provides that reliable operating torque while still using only minimal space (i.e., it simply defines a pivot shaft without requiring other bulky components as found with some prior art pivots), and thus may readily be used with most existing pivotable handle structures.

Still other aspects, objects, and advantages of the present invention can be obtained from a study of the specification, the drawings, and the appended claims.

I claim:

1. A pivotal connection between a handle and a housing, comprising:

a cylindrical opening through the handle;

a pair of cylindrical openings through said housing, said housing openings being concentric with and on opposite sides of the handle opening; and a pivot defining member having an outer surface biased outwardly into frictional contact with the handle opening and housing openings, including a sleeve portion with an outer diameter $O_S$ substantially equal to or less than the diameter of said housing and handle openings, said sleeve portion further including a tubular opening having a selected inner diameter $I_S$, a longitudinally extending pin portion circumscribed by a reference cylinder having an outer diameter $D_C$ and having a section on one end inscribing a reference cylinder, said inscribed reference cylinder having a diameter $D_I$ wherein $D_I \leqq I_S < D_C < O_S$, and breakable circumferentially disposed connecting segments projecting radially outwardly from the pin portion one end section, said connecting segments being breakably secured to said sleeve portion;

wherein said pivotal connection is formed by the steps of locating said sleeve portion within said housing and handle openings, and forcing said pin portion into said sleeve portion tubular opening.

2. The pivotal connection of claim 1, wherein said pin portion is tapered inwardly toward its end section.

3. A pivotal connection between a handle and a housing, comprising:

a cylindrical opening through the handle;

a pair of cylindrical openings through said housing, said housing openings being concentric with and on opposite sides of the handle opening; and a pivot defining member having an outer surface biased outwardly into frictional contact with the handle opening and housing openings, including a sleeve portion with an outer diameter $O_S$ substantially equal to or less than the diameter of said housing and handle openings, said sleeve portion further including a tubular opening having a selected inner diameter $I_S$, and a longitudinally extending non-cylindrical pin portion inscribing a first reference cylinder having a diameter $D_I$ and circumscribed by a second reference cylinder having a diameter $D_C$, wherein $D_I \leqq I_S < D_C < O_S$, said sleeve portion and pin portion being longitudinally secured end to end whereby said inscribed first reference cylinder is substantially concentrically oriented with said sleeve portion tubular opening;

wherein said pivotal connection is formed by the steps of locating said sleeve portion within said housing and handle openings, and forcing said pin portion into said sleeve portion tubular opening.

4. The connection of claim 3, wherein the outer circumference of the pin portion is greater than the circumference of the tubular opening of the sleeve portion.

5. The connection of claim 4, wherein the outer circumference of the pin portion is at least 5% greater than the circumference of the tubular opening of the sleeve portion.

6. The connection of claim 3, wherein $O_S$ is less than the diameter of the housing and handle openings by an amount which is less than the difference between $D_C$ and $I_S$.

7. The connection of claim 3, wherein said sleeve portion and pin portion are made of plastic.

8. The connection of claim 7, wherein said pin portion is solid.

9. The connection of claim 3, wherein said handle is the locking handle of a window lock, and said handle is frictionally maintained in position relative to the housing until moved by an operator.

10. The connection of claim 3, wherein said pin portion has an outer surface which in transverse cross section substantially defines an equilateral convex polygon having at least three sides.

11. In a window lock having a handle with a grasping portion for grasping a keeper, said handle extending through a slot in a base housing and being pivotally connected thereto, said handle and housing pivotal connection comprising:

a handle pivot portion disposed within said housing slot and having a cylindrical opening with a first diameter H;

coaxial cylindrical openings on opposite sides of the housing slot, each of said housing openings having a selected diameter substantially equal to the first diameter H; and a pivot defining member securing said handle at any selected pivoted position relative to said housing by biasing its outer surface into frictional contact with the handle opening and housing openings, including a sleeve portion with an outer diameter $O_S$ and located within said housing and handle openings, said sleeve portion further including a tubular opening having a selected inner diameter $I_S$, and a longitudinally extending non-cylindrical pin portion inscribing a first reference cylinder having a diameter $D_I$ and circumscribed by a second reference cylinder having a diameter $D_C$, wherein $D_I \leqq I_S < D_C < O_S \leqq H$, said sleeve portion and pin portion in a first state being longitudinally secured with an end to end connection whereby said inscribed first reference cylinder is substantially concentrically oriented with said sleeve portion tubular opening, wherein said pivot defining member has a second state for securing the pivotal connection in which said pin portion is in said sleeve portion tubular opening with said end to end connection broken.

12. The window lock of claim 11, wherein said pin portion includes at least three longitudinally extending and circumferentially spaced convex biasing portions, said biasing portions being substantially circumscribed by said second reference cylinder and said pin portion in said first state being secured to the sleeve portion only at the ends of the biasing portions.

13. The window lock of claim 11, wherein said pin portion has an outer surface which in transverse cross section substantially defines an equilateral convex polygon having at least three sides.

14. The window lock of claim 13, wherein said polygon is an octagon.

15. The window lock of claim 11, wherein the outer circumference of the pin portion is greater than the circumference of the tubular opening of the sleeve portion.

16. The window lock of claim 15, wherein the outer circumference of the pin portion is at least 5% greater than the circumference of the tubular opening of the sleeve portion.

17. The window lock of claim 11, wherein $H-O_S<D_C-I_S$.

18. The window lock of claim 11, wherein said sleeve portion and pin portion are made of plastic.

19. The window lock of claim 18, wherein said pin portion is substantially solid.

20. A pivotal connection between a handle and a housing, comprising:

a cylindrical opening through the handle;

a pair of cylindrical openings through said housing, said housing openings being concentric with and on opposite sides of the handle opening; and a pivot defining member having an outer surface biased outwardly into frictional contact with the handle opening and housing openings, including a sleeve portion with an outer diameter $O_S$ substantially equal to or less than the diameter of said housing and handle openings, said sleeve portion further including a central opening having a selected inner circumference $IC_S$, and a longitudinally extending pin portion having a transverse cross sectional shape different than the transverse cross sectional shape of the sleeve portion central opening, said pin portion further having an outer circumference $OC_P$ which is greater than the sleeve portion inner circumference $IC_S$, said sleeve portion and pin portion in a first state being longitudinally secured with an end to end connection at circumferentially spaced points;

wherein said pivot defining member has a second state for securing the pivotal connection in which said pin portion is in said sleeve portion tubular opening with said end to end connection broken.

21. The pivotal connection of claim 20, wherein $OC_P \geqq 1.05\ (IC_S)$.

22. The pivotal connection of claim 20, wherein said pin portion includes at least three longitudinally extending and circumferentially spaced convex biasing portions, with one end of each biasing portion being secured to the sleeve portion at the circumferentially spaced points.

23. The pivotal connection of claim 22, wherein said pin portion has an outer surface which in transverse cross section substantially defines an equilateral convex polygon having at least three sides, the intersection of said sides defining said biasing portions.

24. The pivotal connection of claim 23, wherein said polygon is an octagon.

25. The pivotal connection of claim 20, wherein said sleeve portion and pin portion are made of plastic.

26. The pivotal connection of claim 25, wherein said pin portion is substantially solid.

27. A method for pivotally connecting a handle to a housing, comprising the steps of:

aligning the handle between housing portions with openings through said handle and said housing portions being disposed substantially concentric to one another;

providing a unitary pivot defining member including a sleeve portion with an outer diameter $O_S$ substantially equal to or less than the diameter of said housing and handle openings, said sleeve portion further including a tubular opening having a selected inner diameter $I_S$, a longitudinally extending non-cylindrical pin portion inscribing a first reference cylinder having a diameter $D_I$ and circumscribed by a second reference cylinder having a diameter $D_C$, wherein $D_I \leqq I_S < D_C < O_S$, said sleeve portion and pin portion having an end to end connection at circumferentially spaced points whereby said inscribed first reference cylinder is substantially concentrically oriented with said sleeve portion tubular opening, locating the sleeve portion within said housing and handle openings; and forcing the pin portion toward the sleeve portion opening whereby the connections between the sleeve portion and pin portion are first broken and the pin portion is then slid into said sleeve portion tubular opening to bias the sleeve portion outwardly into frictional engagement with the handle and housing.

* * * * *